US005137016A

United States Patent [19]

Yamasaki et al.

[11] Patent Number: 5,137,016

[45] Date of Patent: Aug. 11, 1992

[54] AUTOMATIC MULTIFUNCTION MASSAGER FOR CHAIR

[75] Inventors: Yoshikiyo Yamasaki, Sakai; Sinichiro Fujimoto, Osaka, both of Japan

[73] Assignees: Kabushiki Kaisha Japan Health; Kabushiki Kaisha Fuji Iryoki, both of Sakai, Japan

[21] Appl. No.: 662,169

[22] Filed: Feb. 28, 1991

[51] Int. Cl.[5] ..... A61H 7/00

[52] U.S. Cl. ..... 128/52; 128/57; 128/33; 128/60

[58] Field of Search ..... 128/33, 24.1, 52, 58, 128/56, 57, 35, 60, 24.3, 44, 45, 46; 297/284 C, 284 F, 310

[56] References Cited

U.S. PATENT DOCUMENTS

| | | | |
|---|---|---|---|
| 2,359,933 | 10/1944 | Niblack | 128/58 |
| 3,092,100 | 6/1963 | Oetinger | 128/33 |
| 3,678,923 | 7/1972 | Oetinger | 128/33 |
| 3,948,379 | 4/1976 | Warner | 128/24.1 |
| 4,023,566 | 5/1977 | Martinmass | 128/33 |
| 4,258,706 | 3/1981 | Shank | 128/33 |
| 4,327,713 | 5/1982 | Okazaki | 128/52 |
| 4,615,336 | 10/1986 | Fijimoto | 128/52 |
| 4,686,967 | 8/1987 | Hashimoto | 128/52 |
| 4,718,408 | 1/1988 | Barreiro | 128/52 |
| 5,020,518 | 6/1991 | Spears | 128/33 |

FOREIGN PATENT DOCUMENTS

| | | | |
|---|---|---|---|
| 111315 | 10/1983 | Fed. Rep. of Germany | 128/32 |

*Primary Examiner*—Danton D. DeMille
*Assistant Examiner*—David Kenealy
*Attorney, Agent, or Firm*—Flynn, Thiel, Boutell & Tanis

[57] ABSTRACT

An automatic multifunction massager is applied to a massager chair having a backrest and a seat. A massaging unit is disposed inside the backrest of the massager chair, and has a massaging mechanism for optionally carrying out a patting motion and a massaging motion through a pair of left and right massaging rolls, and a lifting mechanism for supporting and moving the massaging mechanism up or down. A rolling unit is disposed inside the seat of the massager chair, and has a rotary cylinder incorporating a driving mechanism, and a plurality of rotatable roller groups disposed on the peripheral face of the rotary cylinder. The chair may also have a footrest with rolling unit provided therein.

4 Claims, 7 Drawing Sheets

AUTOMATIC MULTIFUNCTION MASSAGER FOR CHAIR

FIELD OF THE INVENTION

The present invention relates to a chair-type massager, and particularly to an automatic multifunction massager than can optionally carry out a massaging function and a knocking function on the back of a person, as well as a sliding acupressure function on the buttocks and legs of the person.

BACKGROUND OF THE INVENTION

A conventional chair-type automatic massager has a backrest that incorporates a vertical threaded shaft. The threaded shaft is rotated in forward or reverse directions by a motor. To this threaded shaft, there is fitted a massaging device having massaging balls for carrying out massaging (i.e. rubdown) and knocking (i.e. patting) motions. The massaging device is moved up or down through the threaded shaft to an optional position on the back of a person to massage the position.

In recent years, some massagers are provided with left and right rollers instead of the conventional massaging balls. The rollers are continuously moved up and down to perform a rolling massage on the back, spinal cord, and peripheral areas of the spinal cord of a person.

One known massager is disclosed in U.S. Pat. No. 4 615 336 (Fujimoto).

The conventional chair-type automatic massagers massage only the back of a person, and none of them can simultaneously or properly massage the whole of the back side of a person.

There is a need, therefore, to provide a multifunction massager that can properly massage the back of a person as in the conventional massagers, and in addition the buttocks and legs of the person.

SUMMARY OF THE INVENTION

An object of the present invention is to provide an automatic multifunction massager for a massager chair. The massager comprises a massaging unit disposed inside a backrest of the massager chair. The massaging unit is movable up or down inside the backrest to perform two kinds of actions, i.e., a massaging (i.e. rubdown) action and a knocking (i.e. patting) action. The massager further comprises rolling units having a rolling function and disposed inside a seat and a retractable footrest of the chair. The massaging unit and rolling units can optionally be set to selectively massage the back, buttocks, and legs of a person.

According to the present invention, an automatic multifunction massager is applied to a massager chair having a backrest and a seat, and comprises a massaging unit disposed inside the backrest of the massager chair. The massaging unit has a massaging mechanism for optionally carrying out two kinds of motions, i.e., a knocking or patting motion and a massaging or rubdown motion through a pair of left and right massaging balls, and a lifting mechanism for supporting and moving the massaging mechanism up or down to perform a rolling massaging motion. The massager further comprises a rolling unit disposed inside the seat of the massager chair. The rolling unit has a rotary cylinder incorporating a driving mechanism, and a plurality of rotatable roller groups disposed on the whole peripheral face of the rotary cylinder.

According to the present invention, the rolling unit disposed inside the seat of the massager chair can gradually move up or down.

According to another aspect of the present invention, an automatic multifunction massager is applied to a massager chair having a backrest, a seat, and a retractable footrest, and comprises a massaging unit disposed inside the backrest of the massager chair. The massaging unit has a massaging mechanism for optionally carrying out two kinds of motions, i.e., a knocking motion and a massaging motion through a pair of left and right massaging balls, and a lifting mechanism for supporting and moving the massaging mechanism up or down. The massager further comprises rolling units disposed inside the seat and the footrest of the massager chair. Each of the rolling units has a rotary cylinder incorporating a driving mechanism, and a plurality of rotatable roller groups disposed on the whole peripheral face of the rotary cylinder.

The automatic multifunction massager of the present invention with the above-mentioned arrangement operates as follows:

The backrest of the massager chair incorporates the massaging mechanism that can operate the left and right massaging balls to optionally perform the knocking motion and the massaging motion. A user can, therefore, optionally select the knocking massage or the usual massage on the back of the user. The rolling unit disposed inside the seat can be used separately or simultaneously to carry out a sliding acupressure massage on the buttocks of the user. The user can thus select a whole body massage, if necessary.

The rolling unit disposed inside the seat can move up or down so that it may be moved upward to enhance the sliding acupressure effect. When not used, the rolling unit may be brought down to prevent it from being damaged due to shocks, and to prevent a user from feeling uncomfortableness when seated.

The rolling unit disposed inside the retractable footrest can optionally carry out the sliding acupressure massage on the legs. The whole body of the user, i.e., the back, buttocks, and legs may separately or simultaneously be massaged by the massager of the present invention.

Attention is also directed to copending application U.S. Ser. No. 07/407 893 which discloses a similar massaging unit incorporated into a chair back. The disclosure of this copending application is incorporated herein by reference.

BRIEF DESCRIPTION OF THE DRAWINGS

Embodiments of the automatic multifunction massager of the present invention will be explained in detail with reference to the drawings wherein.

DETAILED DESCRIPTION

Figure 1:
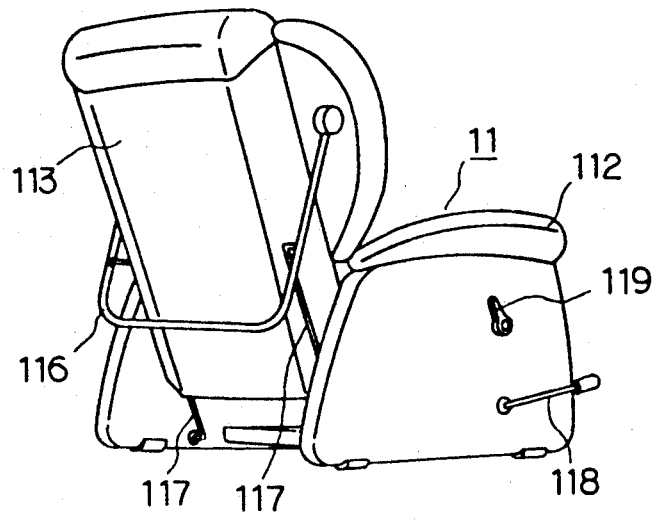
FIG. 1 is a perspective view showing a massager chair with an automatic multifunction massager according to an embodiment of the present invention.
Figure 2:
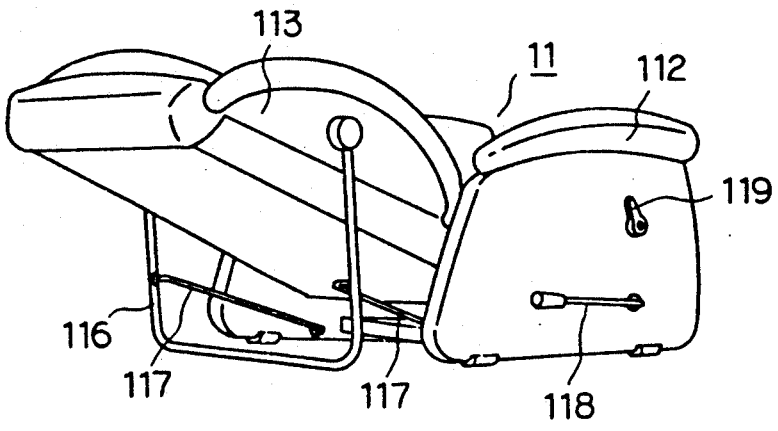
FIG. 2 is an explanatory view showing the massager chair with the automatic multifunction massager.

FIGS. 1-5 show the massager chair 11 to which an automatic multifunction massager 1 of the present invention is applied. The massager chair 11 comprises a seat 111, a pair of armrests 112 fixed to each side of the seat 111, a reclining backrest 113 disposed at the back of the seat 111, a hydraulic cylinder 115 for supporting and tilting the back rest 113, and a retractable footrest 114 that can move forward in front of the seat 111.

Figure 3:
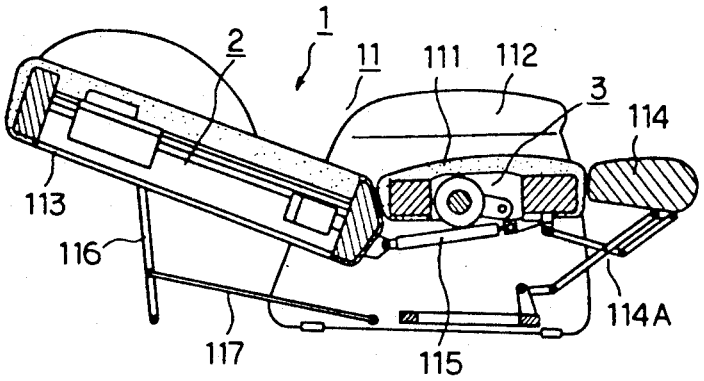
FIG. 3 is a vertical section showing the automatic multifunction massager.
Figure 4:
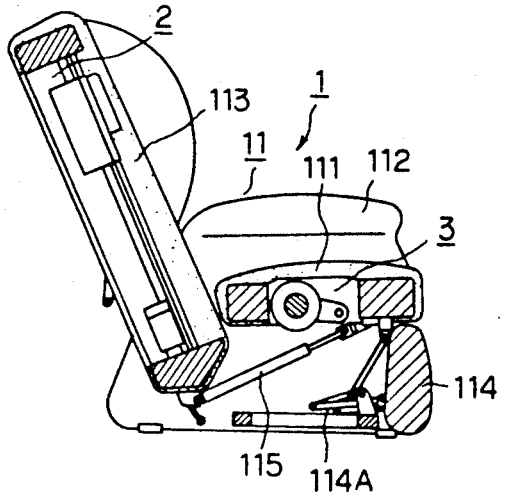
FIG. 4 is a vertical section showing the automatic multifunction massager.
Figure 5:
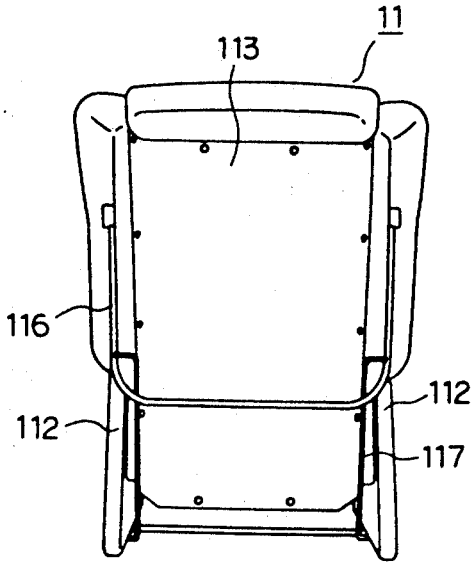
FIG. 5 is a back view showing the massager chair with the automatic multifunction massager.

As shown in FIGS. 3 and 4, the footrest 114 can move about 90 degrees by a conventional link mechanism 114A. One end of the link mechanism 114A is connected to a lower part of the seat 111, and another end thereof is connected to a lower part of the massager chair 11.

Numeral 116 denotes a support bar that supports the backrest when the same is inclined. The support bar 116 has a U shape, and both ends thereof are fitted to each side of the backrest 113 and covered thereby.

Numeral 117 denotes inclination adjusting bars for adjusting the inclination of the support bar 116. One end of the inclination adjusting bars 117 are fitted to each side of the support bar 116, and the other ends thereof are fitted to the armrests 112.

Numeral 118 denotes a reclining lever for reclining the backrest 113. The reclining lever 118 is interlocked with the hydraulic cylinder 115 for activating the cylinder.

Figure 6:
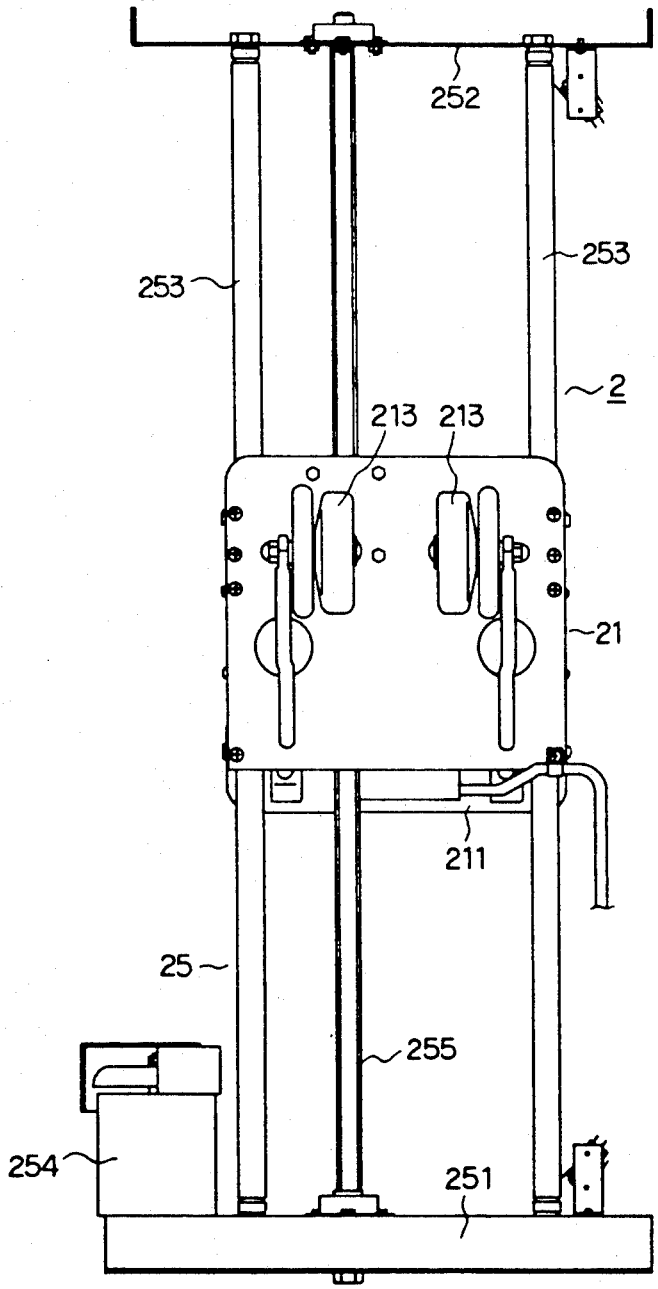
FIG. 6 is a front view showing a lifting mechanism of the automatic multifunction massager.
Figure 7:
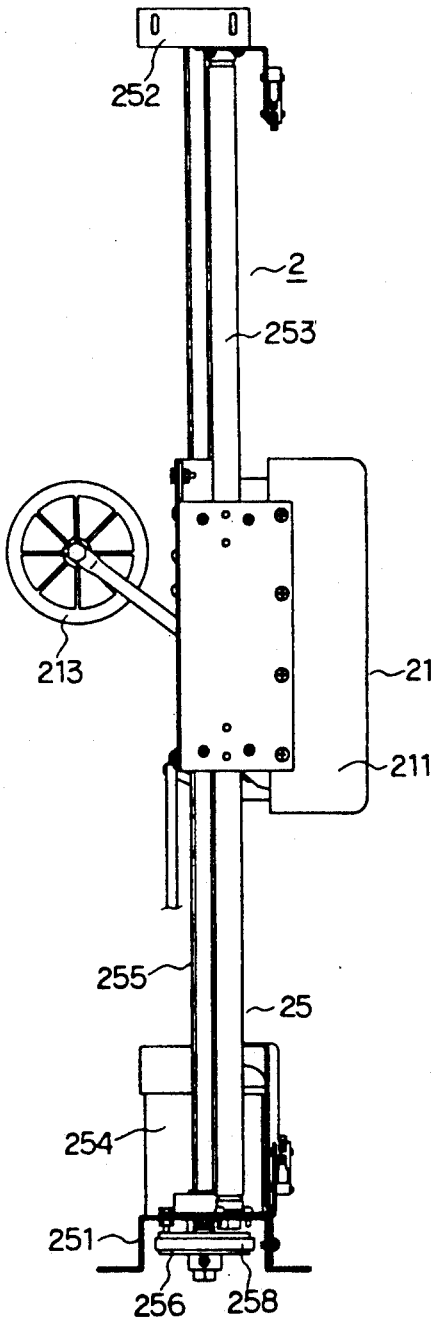
FIG. 7 is a side view showing the lifting mechanism.
Figure 13:
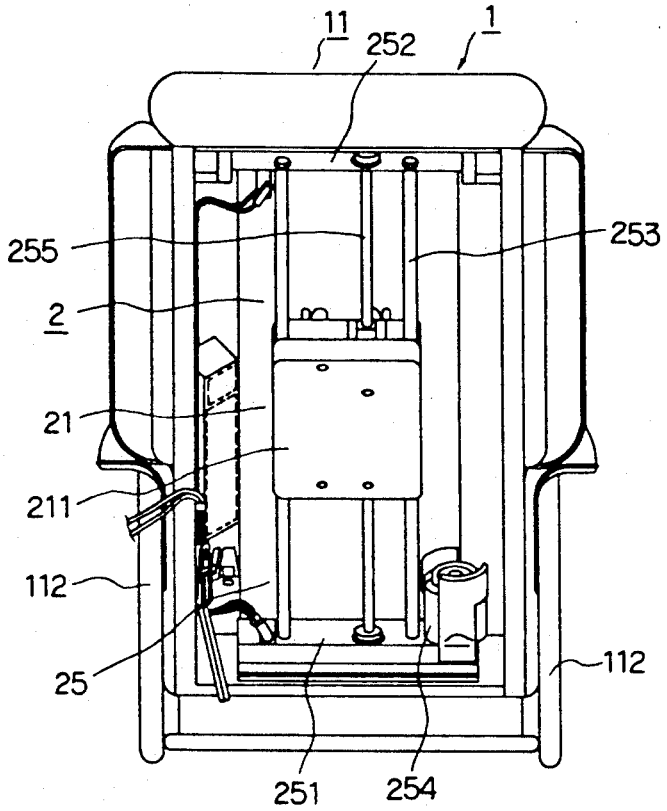
FIG. 13 is a sectional view showing a rolling unit of the automatic multifunction massager of the present invention.
Figure 14:
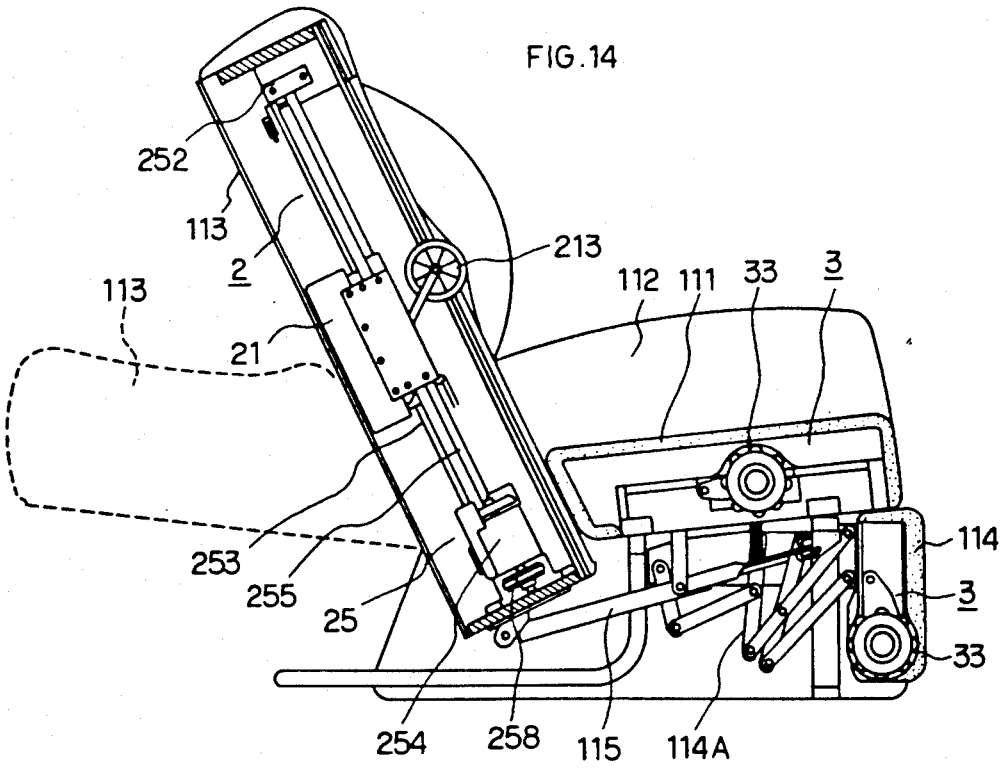
FIG. 14 is a sectional view taken along line A—A of FIG. 13.

The automatic multifunction massager 1 of the present invention is manufactured with the massager chair 11. The backrest 113 of the massager chair 11 incorporates a massaging unit 2. The massaging unit 2 (FIGS. 6 and 7) comprises a massaging mechanism 21 that can activate a pair of left and right massaging balls or rollers to optionally carry out two motions, i.e., a knocking motion and a massaging motion, and a lifting mechanism 25 for supporting and moving the massaging mechanism 21 up or down. The seat 111 of the massager chair 11 incorporates a rolling unit 3 (FIGS. 12-14) which comprises a rotary cylinder 32 incorporating a driving mechanism 31, and a plurality of rotatable roller groups 33 disposed on the whole peripheral face of the rotary cylinder 32.

Figure 9:
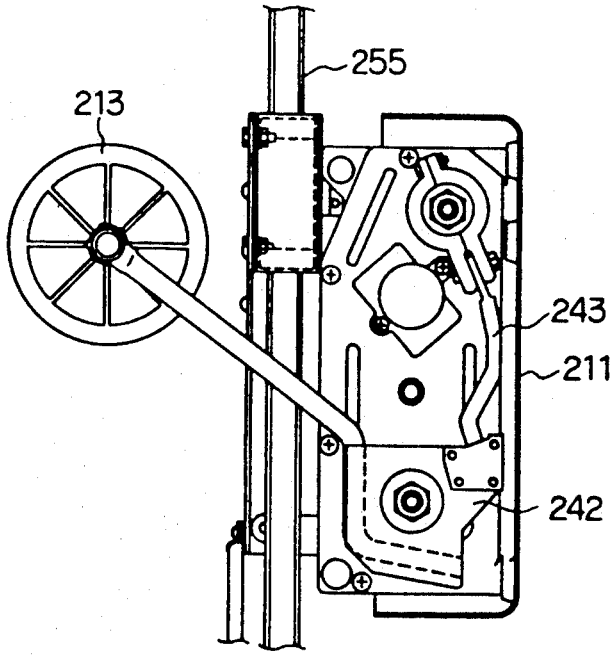
FIG. 9 is a side view showing a massaging mechanism of the automatic multifunction massager.
Figure 10:
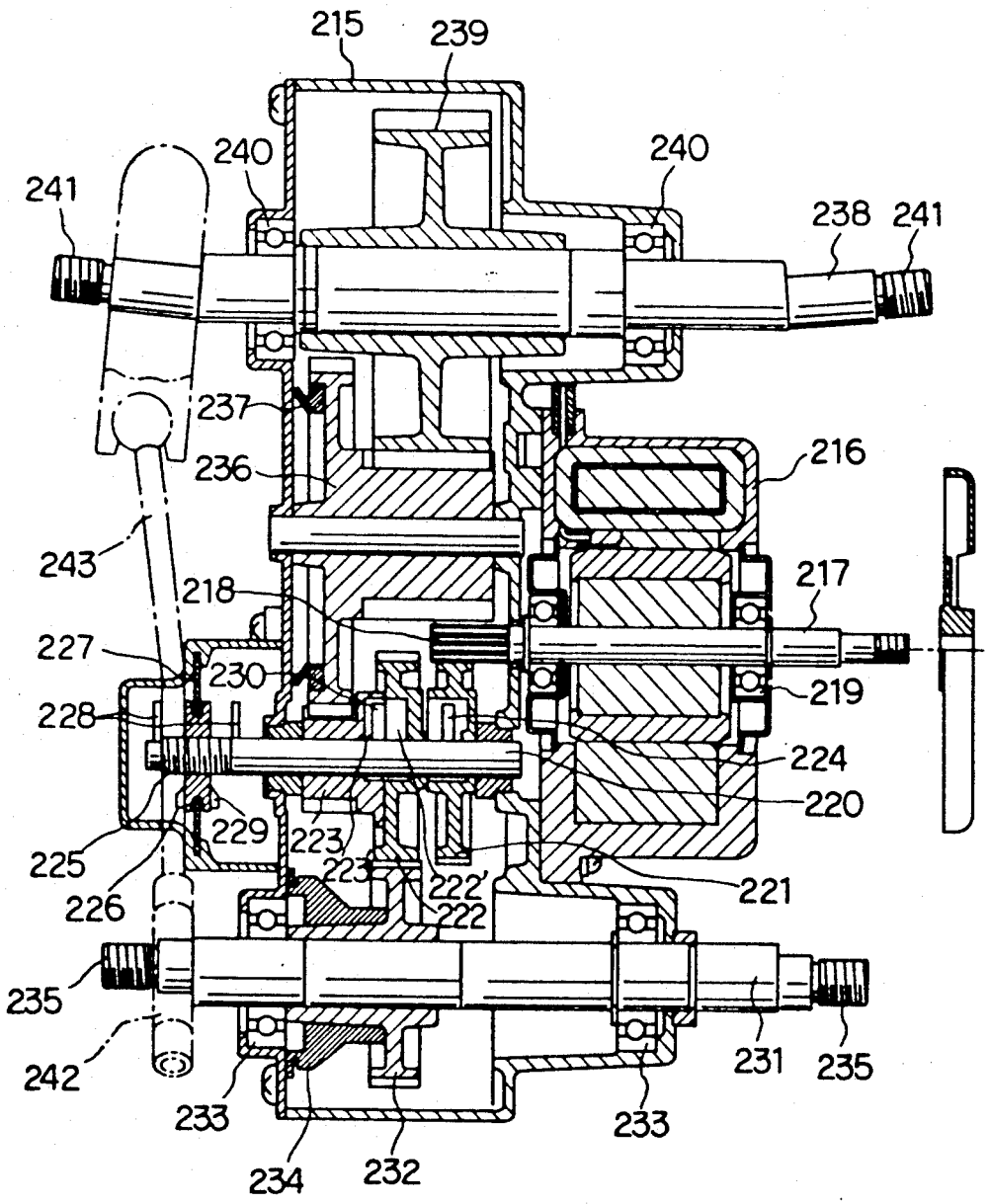
FIG. 10 is an explanatory view showing the massaging mechanism.
Figure 11:
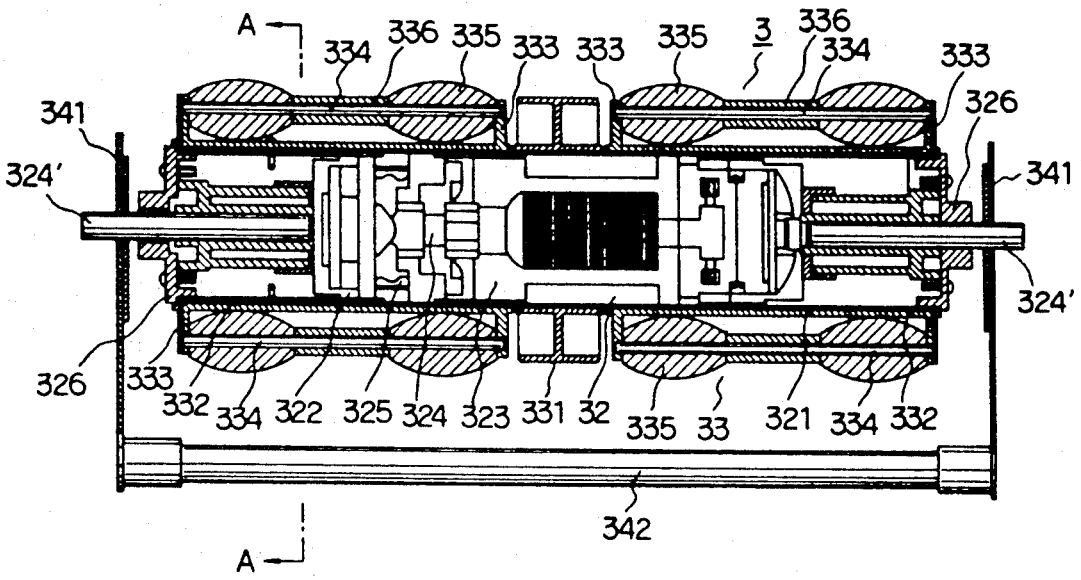
FIG. 11 is an explanatory view showing the automatic multifunction massager.

As shown in FIGS. 9 and 10, in the massaging mechanism 21, a box or housing 211 accommodates a motor 216, which interlocks with a main shaft 220. The main shaft 220 is rotated in a gearbox 215 in a forward or reverse direction by the motor 216. The main shaft 220 separately drives different planetary gears 222 and 223. The main shaft 220 also separately and silently drives different follower shafts 231 and 238. A pair of massaging balls 213 is connected to each ends of the facing follower shafts 231 and 238 through a connection shaft 243 and a connection member 242, so that the massaging balls 213 may perform the two different motions.

The motor 216 has a drive shaft 217 one end of which is formed into a gear 218. Each end of the drive shaft 217 is supported by a bearing 219. The one end of the drive shaft 217 is disposed inside the gearbox 215, so that the gear 218 may mesh with a main gear 221 on the main shaft 220 to drive the main shaft 220.

An end of the main shaft 220 is a threaded portion 225. A support member 226 held by a spring 227 is screwed to the threaded portion 225, and the support member 226 is resiliently supported by the main shaft 220.

The planetary gears 222 and 223 nave drum-shaped center grooves 222' and 223', and are fixed to the main shaft 220 in parallel with the main gear 221 such hat the grooves 222' and 223' face each other. A follower pin 230 engaging with the grooves 222' and 223' and a main pin 224 engaging with the main gear 221 are radially disposed on the main shaft 220. These elements engage with one another to rotate the main shaft 220, thereby transmitting torque to the two follower shafts 231 and 238 to be explained later.

At opposite ends of the threaded portion 225 of the main shaft 220, there are radially arranged fixed pins 228. Engaging with these fixed pins 228 are stops 229 on the support member 226. When the main shaft 220 rotates, the support member 226 axially moves, and the stops 229 engage with the fixed pins 228 at each end of the threaded portion 225, thereby switching power transmission to the follower shaft 231 or 238.

The first follower shaft 231 has fixed thereon a first follower gear 232 that meshes and rotates with the planetary gear 222 of the main shaft 220. Each end of the follower shaft 231 is supported by a bearing 233. Between the first follower gear 232 and the gearbox 215, there is arranged a crown-shaped elastic member 234. The elastic member 234 absorbs noise caused by play relative to the gearbox 215 when the follower shaft 231 rotates. Also, the bearings 233 suppress the play, thereby rotating the follower shaft 231 as smooth as possible.

The second follower shaft 238 has fixed thereon a second follower gear 239, which meshes with a rotary gear 236 that meshes and rotates wi&h the planetary gear 223. Each end of the second follower shaft 238 is supported by a bearing 240, and is eccentrically bent. The second follower shaft 238 is smoothly rotated by the main shaft 220.

Numeral 237 denotes a crown-shaped elastic member disposed between the rotary gear 236 and the gearbox 215. The elastic member 237 absorbs noise caused by play relative to the gearbox 215 when the second follower shaft 238 rotates.

The connection member 242 has a central bearing (not shown) through which it is fitted to a threaded portion 235 formed at each end of the first follower shaft 231. An upper part of the connection shaft 243 is fitted to a threaded portion 241 formed at each end of the second follower shaft 238, and a lower part of the connection shaft 243 is supported by a spherical bearing of the connection member 242, so that the first follower shaft 231 may cooperate with the second follower shaft 238 as shown in FIG. 9.

The massaging ball or roller 213 has an arm fitted within a groove formed on the connection member 242.

The lifting mechanism 25 is disposed inside the backrest 113, and moves the massaging mechanism 21 up or down. As shown in FIGS. 6, 7, 8, and 11, a frame of the lifting mechanism 25 comprises a base plate 251 disposed on the bottom of the backrest 113, a top plate 252 fixed to the top of the backrest 113, and a pair of support rods 253 that extend upright between the base plate 251 and the top plate 252 and are parallel with each other. An upright threaded shaft 255 is disposed between and in parallel with the support rods 253. The threaded shaft 255 is driven by a motor 254 and is rotatable in a forward or reverse direction. The massaging mechanism 21 is fitted to the threaded shaft 255 of the lifting mechanism 25, and slidably supported on the pair of support rods 253 so that the massing mechanism 21 may ascend and descend.

Figure 8:
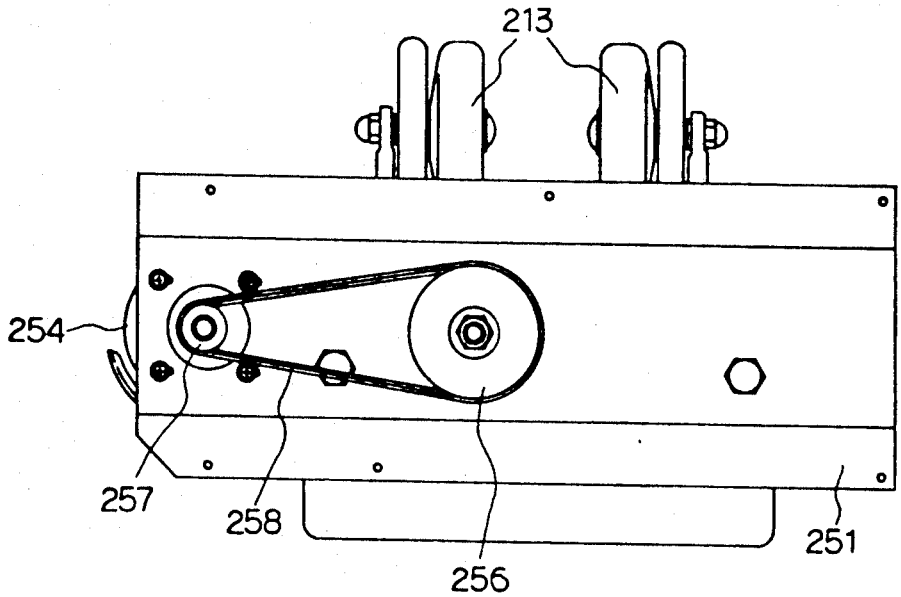
FIG. 8 is a plan view showing the lifting mechanism.

Numeral 256 denotes a pulley fitted to a lower part of the threaded shaft 255 and, as shown in FIG. 8, the pulley 256 and motor pulley 257 of motor 254 are connected to each other through a V belt 258 so that the forward or reverse rotations of the motor 254 are transmitted to the threaded shaft 255.

In FIGS. 3, 4, 12, 13, and 14, the rolling unit 3 is disposed inside the seat 111 of the massager chair 11. The rolling unit 3 comprises a rotary cylinder 32 having a crown-shaped holding member 326 at each end thereof, and a plurality of rotatable roller groups 33 disposed around the whole peripheral face of the rotary cylinder 32. The rotary cylinder 32 has a cylindrical body 321 in which a driving mechanism 322 is disposed. The driving mechanism 322 comprises a motor 323 and a reduction gear 325 that are connected to each other. The driving mechanism 322 rotates the rotatable roller groups 33.

The driving mechanism 322 comprises the motor 323 and the reduction gear 325 fixed to a drive shaft 324 of the motor 323. An inner part of the cylindrical body 321 is fixed to an outer part of the reduction gear 325, so that rotations of the motor 323 optionally reduced by the reduction gear 325 may be transmitted to the cylindrical body 321 to rotate the same.

The crown-shaped holding members 326 fitted to each end of the cylindrical body 321 close and support the driving mechanism 322. Drive shafts 324' of the driving mechanism 322 pass through cylindrical centers of the holding members 326, and are held by bearings (not shown). The drive shafts 324' are fixed to rotate the cylindrical body 321.

The rotatable roller groups 33 comprise a small cylindrical body 331 made of resin or metal disposed at the center of the peripheral face of the rotatable cylindrical body 321; drum bodies 332 made of resin or metal disposed on the left and right sides of the small cylindrical body 331; a plurality of rods 334 extending between both sides 333 of each drum body 332 and disposed at regular angular intervals around each drum body 332; and ellipsoidal massaging members or rollers 335 and cylindrical support members 336 that are alternately disposed on each rod 334. The rotatable roller groups 33 and the cylindrical body 321 are coaxial and rotatable together.

Numeral 34 denotes a reinforcing frame that securely holds the crown-shaped holding members 326 against the side faces of the cylindrical body 321 and prevents the rotatable roller groups 33 from slipping in rotation. The reinforcing frame 34 comprises a pair of forked plates 341 disposed outside the crown-shaped holding members 326 and holding the drive shafts 324' of the driving mechanism 322, and a reinforcing bar 342 connecting the forked plates 341 together.

Numeral 119 (FIGS. 1 and 2) denotes an exterior control lever for raising the rolling unit 3 upward from a lower part of the seat 111 or for returning the rolling unit 3 to the original position. This control lever 119 is drivingly coupled to the rolling unit 3 through any conventional arrangement such as a link or linkage or cam to effect vertical swinging (i.e., raising or lowering) of the roller unit by effecting pivoting thereof about the rod 342. By manually swingably moving this lever 119, a user can raise or lower the roller unit to adjust the contact strength of the rotatable roller groups 33 of the rolling unit 3 against the buttocks of the user.

Operation

The automatic multifunction massager 1 of the present invention is arranged as explained above. To use this massager, a user lays his or her back on the backrest 113 of the massager chair 11, and starts the motor 216 of the massaging mechanism 21 The massaging balls 213 then knock or massage the back of the user. The motor 216 may be operated in a reverse direction to massage or knock the back of the user.

When the user operates the lifting mechanism 25 of the present invention, the massaging mechanism 21 moves up or down to an optional position. If the user continuously operates only the lifting mechanism 25 without operating the massaging mechanism 21, a rolling massage will be done on the back of the user Since the seat 111 of the present invention has the rolling unit 3, the user may operate the motor 323 of the driving mechanism 322 to continuously rotate the rotatable roller groups 33, thereby carrying out a sliding acupressure massage on the buttocks of the user. At this time, if the user simultaneously operates the massaging mechanism 21, the back and buttocks of the user can be massaged at the same time.

ALTERNATE EMBODIMENT

Figure 12:
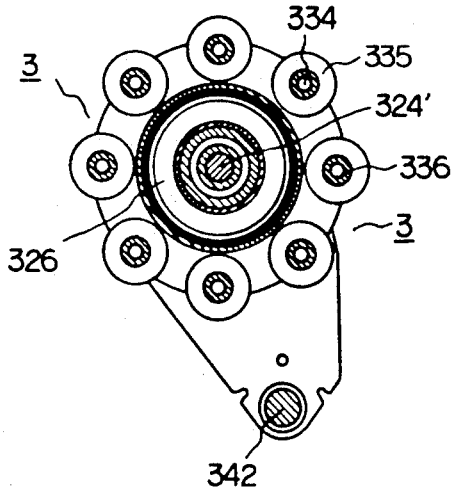
FIG. 12 is an explanatory view showing an automatic multifunction massager according to a second embodiment of the present invention.

FIG. 12 shows an automatic multifunction massager 1 according to a second embodiment of &he present invention. The massager 1 is manufactured with the massager chair 11 as described above. The backrest 113 of the massager chair 11 incorporates the massaging unit 2. The massaging unit 2 comprises the massaging mechanism 21 that can optionally carry out the knocking motion and massaging motion through a pair of left and right massaging balls or rollers, and the lifting mechanism 25 that supports the massaging mechanism 21 so that the massaging mechanism 21 can ascend and descend. Each of the seat 111 and the footrest 114 of the massager chair 11 incorporates the rolling unit 3. The rolling unit 3 comprises the rotary cylinder 32 having the driving mechanism 31, and a plurality of rotatable roller groups 33 disposed on the whole peripheral face of the rotary cylinder 32.

The automatic multifunction massager 1 according to the embodiment of FIG. 12 is substantially as explained above. To use this massager, a user lays his or her back on the backrest 113 of the massager chair 11, and starts the motor 216 of the massaging mechanism 21. The massaging balls 213 then knock or massage the back of the user. The motor 216 may be operated in a reverse direction to massage or knock the back of the user.

When the user operates the lifting mechanism 25 of the present invention, the massaging mechanism 21 moves up or down to an optional position. If the user continuously operates only the lifting mechanism 25 without operating the massaging mechanism 21, a rolling massage will be done on the back of the user.

Since the seat 111 of the present invention has the rolling unit 3, the user may operate the motor 323 of the driving mechanism 322 to continuously rotate the rotatable roller groups 33, thereby carrying out a sliding acupressure massage on the buttocks of the user. At this time, if the user simultaneously operates the massaging mechanism 21, the back and buttocks of the user can be massaged at the same time.

In addition, since the footrest 114 of the present invention has the rolling unit 3, the user may operate the motor 323 of the driving mechanism 322 to continuously rotate the rotatable roller groups 33, thereby carrying out a sliding acupressure massage on the legs of the user. At this time, if the user simultaneously operates the massaging mechanism 21 and the driving mechanism 322 of the seat 111, the back, buttocks, and legs of the user, i.e., the whole body of the user can simultaneously be massaged.

As explained above, an automatic multifunction massager according to the present invention comprises a massaging unit disposed inside a backrest of a massager chair. The massaging unit is movable up or down inside the backrest, and has two kinds of massaging functions, i.e., a usual massaging function and a knocking function. The massager further comprises rolling units disposed in a seat and a retractable footrest of the chair. Each of the rolling units has a rolling function. The massaging unit and rolling units can optionally be set to selectively massage the back, buttocks, and legs of a person. Unlike the conventional massagers that can massage only an optional position on the back of a user, the present invention can separately massage any position on the back, buttocks, and legs of a user, i.e., any position on the whole body of the user in response to a user's request. Also, the present invention can simultaneously massage a combination of positions requested by the user such as the back and buttocks, the back and legs, the buttocks and legs, or the back, buttocks and legs.

The automatic multifunction massager of the present invention can carry out the whole body massage that cannot be done by the conventional automatic massagers, satisfy various requirements, and improve a user's feeling in use.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A reclining, massaging chair, comprising:

a seat having a front end, a rear end and opposite lateral sides;

a pair of stationary arm rests located adjacent to the opposite lateral sides of said seat;

an extendible and retractable footrest adapted to be moved from a position below the front end of said seat to a position extending forwardly from the front end of said seat;

a reclinable backrest located at the rear end of said seat and movable with respect to said arm rests between a substantially upright position and a substantially horizontal, inclined position extending rearwardly from said seat, said backrest having opposite lateral sides;

a substantially U-shaped support bar for supporting said backrest when it is in its inclined position, said support bar having a pair of support legs whose free inner ends are pivotally mounted on said opposite lateral sides of said backrest, said support bar having a bight extending between the outer ends of said support legs and which is adapted to rest on a floor;

inclination adjusting means for adjusting the inclination of said support bar relative to said backrest, one end of said means being pivotally fastened to the lower end of one of said arm rests on the inner side thereof, the other end of said means being pivotally connected to said support bar;

a massaging unit disposed inside said backrest and having a massaging mechanism for optionally carrying out a patting motion and a massaging motion by means of a pair of left and right massaging balls, and a lifting mechanism for supporting and moving the massaging mechanism up or down; and a rolling unit disposed inside each of said seat and said footrest, each of said rolling units having a rotary cylinder incorporating a driving mechanism, a plurality of rotatable roller groups disposed on the periphery of the rotary cylinder, a rod extending across said seat, said rolling unit comprising a frame pivotally supported on said rod for upward and downward movement with respect to said seat, said rotary cylinder being mounted on said frame for vertical swinging movement therewith, said roller groups being mounted in a circular array on the peripheral surface of said cylinder with the radially innermost positions of the surfaces of said roller groups tangentially contacting the peripheral surface of said cylinder so that said cylinder and the axis of said circular array are concentric and said cylinder and said roller groups are rotatable together, and said driving mechanism comprising a motor disposed inside said cylinder.

2. A reclining, massaging chair, comprising:

a seat having a front end, a rear end and opposite lateral sides;

a pair of stationary arm rests located adjacent to the opposite lateral sides of said seat;

an extendible and retractable footrest adapted to be moved from a position below the front end of said seat to a position extending forwardly from the front end of said seat;

a reclinable backrest located at the rear end of said seat and movable with respect to said arm rests between a substantially upright position and a substantially horizontal, inclined position extending rearwardly from said seat, said backrest having opposite lateral sides;

a substantially U-shaped support bar for supporting said backrest when it is in its inclined position, said support bar having a pair of support legs whose free inner ends are pivotally mounted on said opposite lateral sides of said backrest, said support bar having a bight extending between the outer ends of said support legs and which is adapted to rest on a floor;

inclination adjusting means for adjusting the inclination of said support bar relative to said backrest, one end of said means being pivotally fastened to the lower end of one of said arm rests on the inner side thereof, the other end of said means being pivotally connected to said support bar;

a massaging unit disposed inside said backrest and having a massaging mechanism for optionally carrying out a patting motion and a massaging motion by means of a pair of left and right massaging balls, and a lifting mechanism for supporting and moving the massaging mechanism up or down; and a rolling unit disposed inside said seat and having a rotary cylinder incorporating a driving mechanism, a plurality of rotatable roller groups disposed on the periphery of said rotary cylinder, a rod extending across said seat, said rolling unit comprising a frame pivotally supported on said rod for upward and downward movement with respect to said seat, said rotary cylinder being mounted on said frame for vertical swinging movement therewith, said roller groups being mounted in a circular array on the peripheral surface of said cylinder with the radially innermost positions of the surfaces of said roller groups tangentially contacting the peripheral surface of said cylinder so that said cylinder and the axis of said circular array are concentric and said cylinder and said roller groups are rotatable together, and said driving mechanism comprising a motor disposed inside said cylinder.

3. A chair as claimed in claim 2 in which said inclination adjusting means comprises a pair of bars having their outer ends pivotally connected to said support legs between the inner and outer ends thereof, the inner ends of said bars being connected to the inner sides of said arm rests close to the bottom ends thereof.

4. A chair as claimed in claim 1 in which said inclination adjusting means comprises a pair of bars having their outer ends pivotally connected to said support legs between the inner and outer ends thereof, the inner ends of said bars being connected to the inner sides of said arm rests close to the bottom ends thereof.

* * * * *

UNITED STATES PATENT AND TRADEMARK OFFICE

CERTIFICATE OF CORRECTION

PATENT NO. : 5 137 016

DATED : August 11, 1992

INVENTOR(S) : Yoshikiyo YAMASAKI et al.

It is certified that error appears in the above-identified patent and that said Letters Patent is hereby corrected as shown below:

Column 9, line 6; change "balls" to ---rolls---.

Signed and Sealed this

Fifth Day of October, 1993

Bruce Lehman

*Attest:*

BRUCE LEHMAN

*Attesting Officer*

*Commissioner of Patents and Trademarks*